US007458665B2

(12) United States Patent
Batista et al.

(10) Patent No.: US 7,458,665 B2
(45) Date of Patent: Dec. 2, 2008

(54) MACHINE FLUID SUPPLY ASSEMBLY COMPRISING KEYING MEANS

(75) Inventors: Jean-Marc Batista, Bouc Bel Air (FR); Philippe Sarra-Bournet, Aix en Provence (FR)

(73) Assignee: Gemplus, Gemenos (FR)

( * ) Notice: Subject to any disclaimer, the term of this patent is extended or adjusted under 35 U.S.C. 154(b) by 290 days.

(21) Appl. No.: 10/494,307

(22) PCT Filed: Nov. 6, 2002

(86) PCT No.: PCT/FR02/03788

§ 371 (c)(1),
(2), (4) Date: May 3, 2004

(87) PCT Pub. No.: WO03/039877

PCT Pub. Date: May 15, 2003

(65) Prior Publication Data

US 2005/0011916 A1 Jan. 20, 2005

(30) Foreign Application Priority Data

Nov. 6, 2001 (FR) ..... 01 14308

(51) Int. Cl.
*B41J 2/175* (2006.01)
*B67D 5/00* (2006.01)

(52) U.S. Cl. ..... 347/85; 347/84; 347/86; 222/83; 222/91

(58) Field of Classification Search ..... 347/84–87; 222/153.01, 153.04, 81, 86, 91, 82, 88, 324, 222/181.2, 181.3, 325, 400.7, 1, 83, 93, 105; 137/315.04; 285/27, 120.1
See application file for complete search history.

(56) References Cited

U.S. PATENT DOCUMENTS

| | | | | | |
|---|---|---|---|---|---|
| 3,184,782 | A | | 5/1965 | Armour | |
| 3,287,031 | A | * | 11/1966 | Simmons et al. | 285/27 |
| 3,828,973 | A | * | 8/1974 | Birrell | 222/1 |
| 4,211,439 | A | * | 7/1980 | Moldestad | 285/27 |
| 4,411,287 | A | * | 10/1983 | Hyde | 137/315.04 |
| 4,665,960 | A | * | 5/1987 | Brzezicki et al. | 141/384 |
| 4,708,370 | A | | 11/1987 | Todd | |
| 4,907,019 | A | * | 3/1990 | Stephens | 347/86 |

(Continued)

FOREIGN PATENT DOCUMENTS

EP 0523915 A2 1/1993

(Continued)

*Primary Examiner*—Stephen D Meier
*Assistant Examiner*—Rene Garcia, Jr.
(74) *Attorney, Agent, or Firm*—Buchanan, Ingersoll & Rooney, PC

(57) ABSTRACT

The invention relates to a fluid supply assembly for a device, particularly a printing machine. The assembly includes a lower base and is of the type in which the fluid is conditioned in an upper container which is intended to be connected to a fill opening in the base by a coupling. In order to mount the coupling on the base, the coupling is moved linearly along a vertical assembly axis and then pivoted around the assembly axis. The coupling has at least one keying pin which is received in a complementary groove in one face of the base when the coupling is being moved linearly. The invention also relates to a printing machine containing one such assembly.

28 Claims, 7 Drawing Sheets

U.S. PATENT DOCUMENTS 5,102,010 A * 4/1992 Osgar et al. ..... 222/1
5,293,913 A * 3/1994 Preszler ..... 141/367
5,526,956 A * 6/1996 Osgar ..... 222/83
5,920,333 A * 7/1999 Bates ..... 347/85
6,015,068 A * 1/2000 Osgar et al. ..... 222/400.7
6,164,768 A 12/2000 Murphy et al.
6,412,666 B1 * 7/2002 Hogan et al. ..... 222/325
RE38,204 E * 7/2003 Kazarian ..... 285/120.1
6,758,372 B2 * 7/2004 Studer et al. ..... 222/88

FOREIGN PATENT DOCUMENTS

EP 0722837 A1 7/1996
WO WO01/35015 A1 5/2001
WO WO01/80967 A1 11/2001

* cited by examiner

MACHINE FLUID SUPPLY ASSEMBLY COMPRISING KEYING MEANS

BACKGROUND OF THE INVENTION

The invention relates to an assembly for feeding fluid to equipment.

The invention relates more particularly to an assembly for feeding fluid to equipment, in particular for feeding ink, which assembly includes a feed bottom base provided with a filling orifice communicating with at least one feed duct for feeding fluid to the equipment, the assembly being of the type in which the fluid is packaged in a top container provided with a feed opening which is organized to be connected to the filling opening of the feed base via a fitting that is pre-mounted on the container, and of the type including first axial locking means for mounting the fitting on the container and second axial locking means for mounting the fitting on the base, mounting the fitting on the base comprising moving the fitting in translation along a vertical mounting axis, then pivoting the fitting about the mounting axis.

The invention is described herein with reference to printing machines, in which the fluid is therefore an ink. But other applications can be considered, such as to the food industry, the chemicals industry, or analysis laboratories.

When an industrial printing machine uses ink packaged in bottles, it is advantageous to use the bottles directly as ink reservoirs on the machine, without it being necessary to use an intermediate receptacle such as a reservoir or a cartridge mounted on the printing machine. This makes it possible, in particular, to avoid superfluous handling operations and to avoid transferring the ink, which can be difficult to achieve, when filling a reservoir.

Document EP-A-0 808 716 has already proposed such an assembly for feeding ink to a printing machine. That document describes in particular an ink bottle provided with a threaded neck onto which a connecting cap is screwed. The connecting cap is provided with a thread that enables it to be screwed into the tapped hole in a feed base carried by the printing machine.

Generally, a printing machine uses a plurality of ink bottles of identical structures but each containing a different color of ink. The machine operates in a manner such that each base receives a bottle containing a determined color of ink.

With the assembly described in that document, no provision is made to prevent, for example, a bottle containing yellow ink from being mounted on the base organized to feed blue ink to the machine. Such a mounting error causes the machine to malfunction since the print patterns are then printed in the wrong colors.

Such a mounting error then requires the machine to be stopped to enable the feed circuits for feeding ink to the machine to be cleaned, thereby rendering the machine unavailable for a long period, and causing an increase in machine operating costs.

Document U.S. Pat. No. 5,920,333 discloses an assembly which makes it possible to match a bottle of ink of determined color uniquely with the filling orifice of a corresponding reservoir of a printing machine. That document proposes to provide the neck of the bottle with a ring carrying vertical tabs that are organized to be received in complementary axial channels provided in the outside axial wall of a filling orifice of the reservoir.

That type of assembly is not organized to mount the bottle on the base by means of a fitting, and it requires the bottle as equipped with its ring to be aligned accurately relative to the channels.

Document U.S. Pat. No. 6,164,768 proposes an assembly in which the bottle is equipped with a specific cap provided with mating means enabling it to be mounted using bayonet-type fastening in the feed base of the printing machine.

That assembly is complex and it does not solve the problem of matching each ink bottle of a determined color with a determined base.

SUMMARY OF THE INVENTION

For the purpose of remedying those drawbacks, the invention provides an assembly for feeding fluid to equipment, in particular for feeding ink, which assembly includes a feed bottom base provided with a filling orifice communicating with at least one feed duct for feeding fluid to the equipment, the assembly being of the type in which the fluid is packaged in a top container provided with a feed opening which is organized to be connected to the filling opening of the feed base via a fitting that is pre-mounted on the container, and of the type including first axial locking means for mounting the fitting on the container and second axial locking means for mounting the fitting on the base, mounting the fitting on the base comprising moving the fitting in translation along a vertical mounting axis, then pivoting the fitting about the mounting axis, said assembly being characterized in that the fitting or the base is provided with at least one keying finger or at least one keying stud which, while the fitting is moving in translation, is received in groove segment or a channel segment that is matched and that is formed in one face of the base or of the fitting so that the container can be mounted only on a determined base as a function of the matching of the fitting with the base, said matching being defined by the keying finger or the keying stud co-operating with the matched groove segment or channels.

According to other characteristics of the invention:

- the fitting is provided with at least one keying finger which extends substantially vertically downwards and which, while the fitting is being pivoted, is received axially in a matched annular axial groove segment which is formed in a top face of the base facing the finger, so that the container as equipped with the fitting can be mounted only on a determined base provided with the groove matched with the keying finger on the fitting;
- the radial position of the keying finger relative to the mounting axis of the fitting determines the matching;
- each fitting is provided with adjustment means for adjusting the radial position of the keying finger so as to make it possible to choose the matching;
- each keying finger is a removable piece that is mounted in a complementary hole carried by the fitting;
- each fitting is provided with a plurality of holes, each of which is disposed in a distinct radial position relative to the mounting axis;
- at its top axial end, the fitting is provided with a collar that extends substantially radially outwards and that is provided with at least one hole for receiving a keying finger;
- the base carries the keying stud which projects radially relative to the concave axial wall of its filling hole, and the matched channel is provided in the outside axial wall of the bottom segment of the fitting;
- each base is provided with at least two keying studs, and the angular position of the keying studs and of the associated channels relative to the mounting axis determines the matching of the base with the fitting;
- each channel opens out in the bottom axial end of the fitting via a bottom opening or inlet;

the fitting is provided with all of the channels complementary to all of the possible positions for the keying pins, and the fitting is provided with closure means for closing off the inlets of the channels which do not correspond to the actual positions chosen for the keying pins carried by the base matched to the fitting, so as to prevent the fitting from being mounted in a base whose keying pins do not occupy the angular positions corresponding to the "open" channels;

the fitting is provided with a ring which is mounted at its bottom axial end and which is provided with lugs extending radially outwards from its outside axial surface, so as to close off the inlets of the channels which do not correspond to the actual positions chosen for the keying studs;

each channel includes a bottom segment which extends substantially axially upwards from the inlet of the channel and a top segment which extends substantially circumferentially from the top end of the bottom segment, the top segment being provided with locking means for locking the stud so as to enable the fitting to be locked in the base using bayonet-type fastening;

each keying pin is carried by the inner axial end of a screw which is mounted in a radial hole opening out in the concave axial wall of the filling hole of the base;

the base includes a separate sleeve which internally defines the filling hole, which caries the keying pins, and which is mounted in a hole of complementary shape formed in the top face of the base;

the filling hole in the base is tapped and the fitting has a complementary threaded cylindrical portion for mounting the fitting on the base;

the feed hole of the container is provided at the free axial end of a neck provided with a thread and the fitting has a complementary tapped hole for mounting the fitting on the container;

the fitting is provided with visual identification means for visually identifying the chosen matching, in particular a color code associated with each position for the keying finger or for the keying studs; and the container or the fitting is provided with a flow-admitting valve which is triggered by mounting the fitting on the base.

The invention also relates to a printing machine characterized in that it includes an assembly according to any one of the preceding characteristics.

BRIEF DESCRIPTION OF THE DRAWINGS

Other characteristics and advantages of the invention will appear on reading the following detailed description which, to make it easier to understand, is given with reference to the accompanying drawings, in which.

DETAIL DESCRIPTION

In the following description, elements that are identical or similar are given like references.

FIGS. 1 to 6 show a first embodiment of an assembly of the invention for feeding fluid to an industrial printing machine 10.

Figure 1:
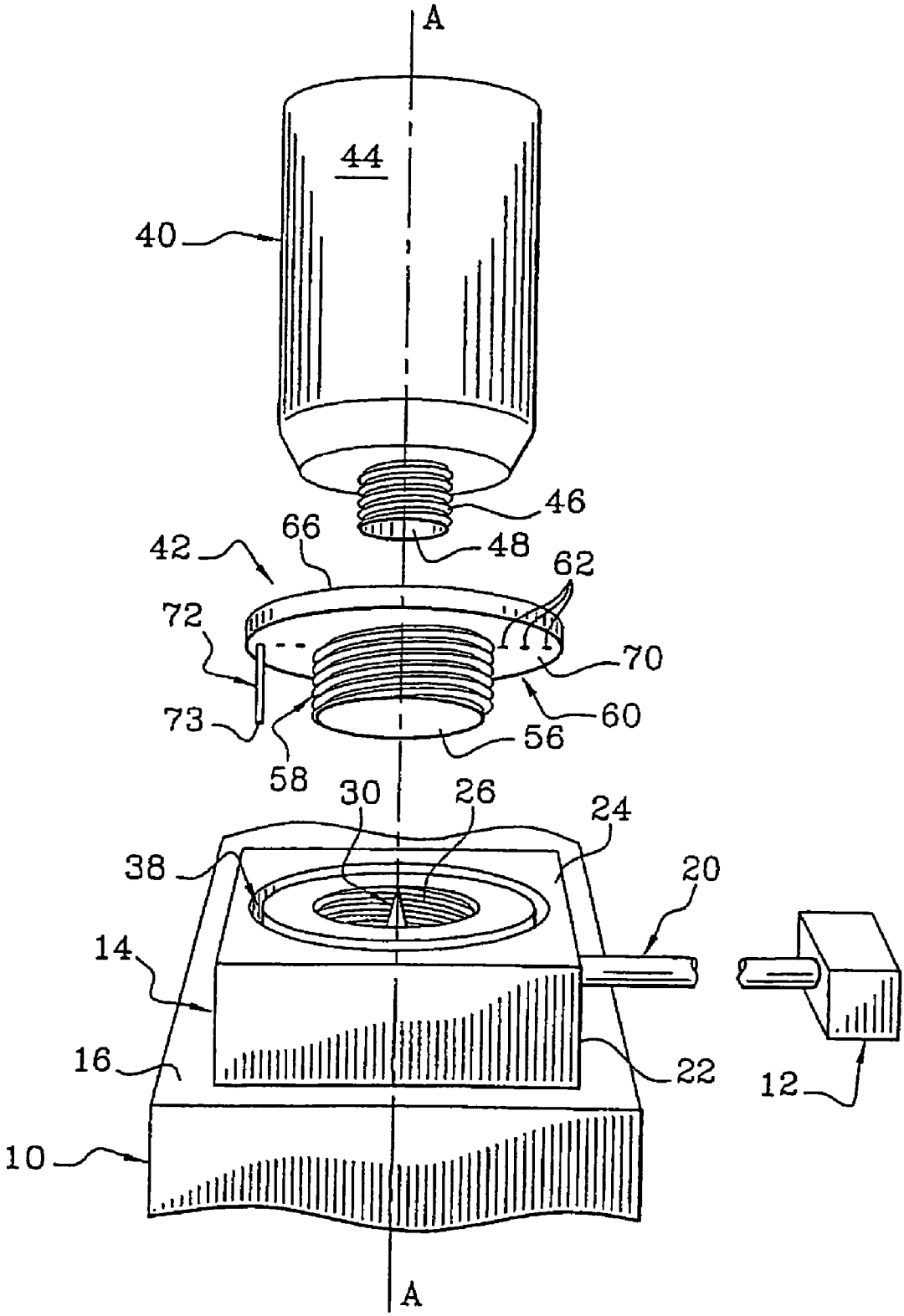
FIG. 1 is an exploded perspective view showing an assembly of the invention for feeding ink to a printing machine, in a first embodiment.
Figure 2:
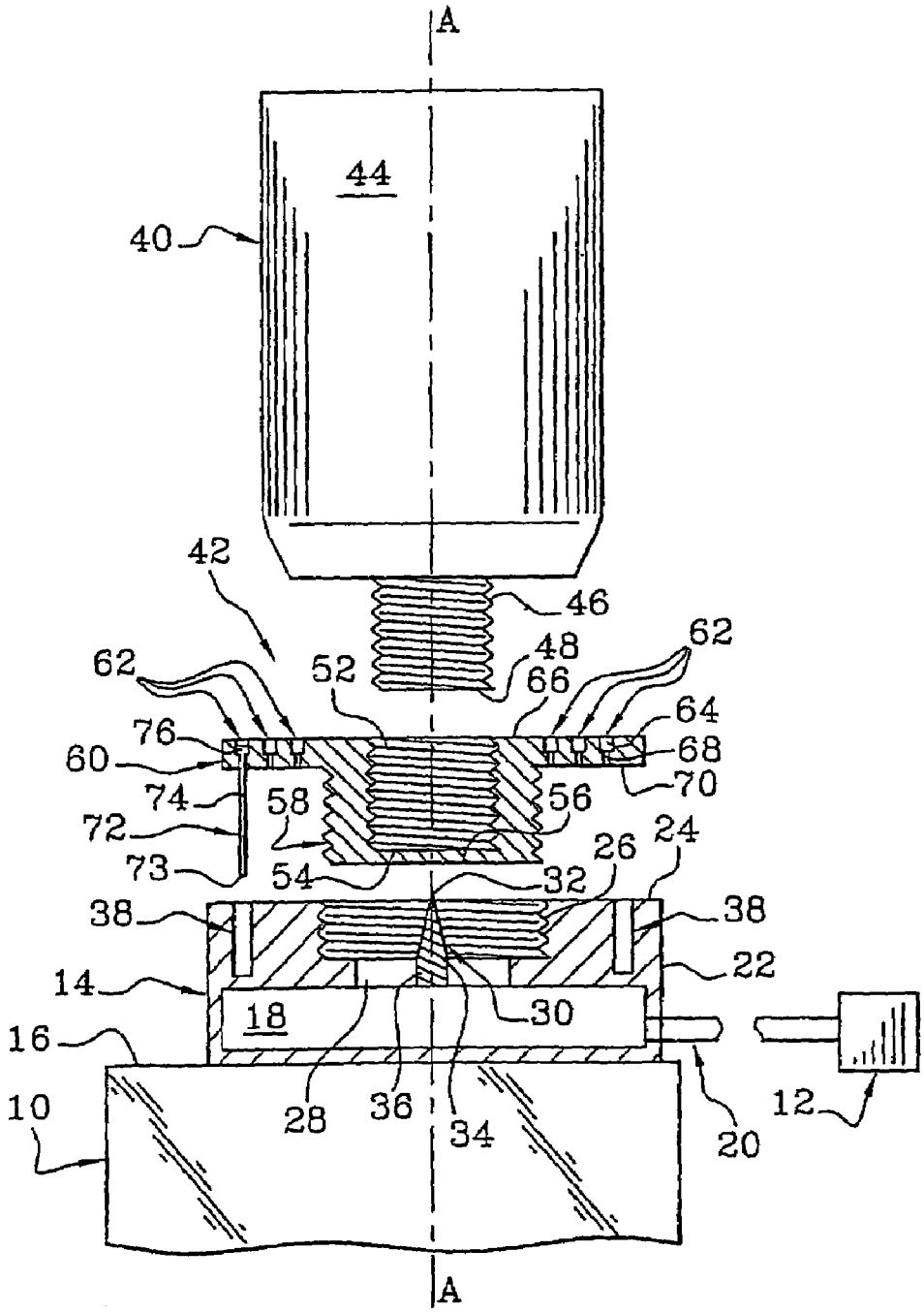
FIG. 2 is an exploded axial section view showing the assembly of FIG. 1.

The printing machine 10 has a plurality of print heads 12, only one of which is shown in FIGS. 1 and 2, and which are controlled, for example by an electronic control unit (not shown), and it includes an ink feed base 14 or a pump base which is associated with each print head 12.

In the description below, in order to make the invention easier to understand, a vertical configuration is used by way of non-limiting example, corresponding to a top-to-bottom configuration in FIGS. 1, 2, 5, and 6.

The feed base 14, which is substantially rectangular block shaped in this example, is mounted on a top wall 16 of the machine 10, and it has a feed chamber 18 in a bottom half that communicates with the associated print head 12 via a feed duct 20.

The feed duct 20 is connected upstream to the feed chamber 18 via one of its side walls 22.

The top face 24 of the feed base 14 is provided with a tapped filling hole 26 which has a vertical axis, and which communicates with the feed chamber 18 via a lower hole 28.

In the description below, and by way of non-limiting example, a vertical axial direction or axis A-A is defined that coincides with the axis of the tapped hole 26 in the base 14.

Advantageously, a piercing finger 30 is provided coaxially inside the tapped hole 26. In this example, it is in the shape of a conical spike whose pointed end 32 extends axially upwards and whose base 34 bears against a crosspiece 36 which extends diametrically inside the lower hole 28.

In accordance with the teaching of the invention, the top face 24 of the base 14 is provided with an annular axial groove 38 which is coaxial with the tapped hole 26 in the base 14.

In addition, a container in the form of a standard-type bottle 40 is shown that serves as a packaging receptacle for the printing ink 41 and that is equipped with a fitting 42 made in accordance with the teaching of the invention.

In this example, the bottle 40 comprises a substantially cylindrical flask or "cylinder" 44 terminated at its bottom end by a threaded neck 46 whose bottom axial end forms the feed opening 48 of the bottle 40.

Figure 3:
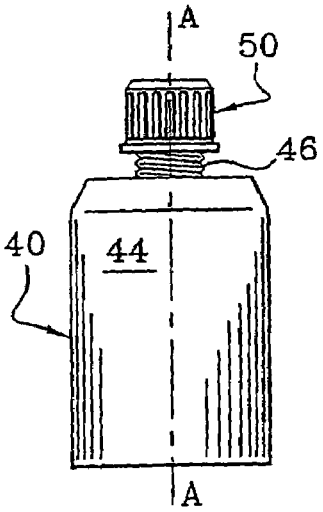
FIG. 3 is a side view showing the ink bottle of the assembly of the invention as equipped with a packaging cap.

As can be seen in FIG. 3, in which the bottle 40 is shown as it is delivered by the ink manufacturer to the printer, the threaded neck 46 constitutes screw-acting axial locking means for axially locking a complementary packaging cap 50, thereby making it possible for the bottle 40 to be closed in leaktight manner while it is being transported.

The fitting 42 is substantially tubular sleeve shaped. It has a top segment which internally defines a tapped hole 52 organized to co-operate in complementary manner with the threaded neck 46 of the bottle 40 with a view to enabling the fitting 42 to be axially locked by being screwed onto the bottle 40, in place of the packaging cap 50.

In the embodiment shown in the figures, the bottom end 54 of the hole 52 of the fitting 42 is closed off by a seal 56 so that the bottle 40 is closed in leaktight manner when the fitting 42 is screwed onto the bottle 40, since the fitting 42 is not yet mounted on the base 14.

The seal 56 is in the form of a fine membrane, e.g. made of a synthetic or natural elastomer material, extending substantially transversely in the bottom end 54 of the tapped hole 52.

The fitting 42 also has a threaded bottom segment 58 which is organized to co-operate in complementary manner with the tapped hole 26 in the feed base 14 with a view to enabling the fitting 42 to be locked axially by being screwed into the base 14.

The top axial end segment of the fitting 42 is provided with a collar 60 which extends substantially radially outwards.

In its axial thickness, the collar 60 is provided with recesses or holes 62. In this example, each hole 62 is in the form of a stepped hole which has a large-diameter top segment 64 opening out into the top radial face 66 of the collar 60, and a small-diameter bottom segment 68 opening out into the bottom radial face 70 of the collar 60.

In the embodiment shown herein, the collar 60 is provided with three identical holes 62 on either side of the axis A-A, and said holes 62 are in line abreast along a diameter of the collar 60.

Advantageously, the holes 62 are not organized symmetrically relative to the axis A-A so that each hole 62 takes up a distinct radial position.

Each hole 62 is organized to receive axially a removable keying finger 72 so that said finger extends vertically downwards from the bottom radial face 70 of the collar 60. FIGS. 1 and 2 show a keying finger 72 mounted in an outer hole 62 in the collar 60 (shown in the left of the collar in this example).

As explained below, the hole 62 receiving the keying finger 72 is chosen so that its radial position corresponds to the diameter Dg of the annular axial groove 38 in the associated base 14.

In this example, the keying finger 72 is in the form of a vertical rod 74 provided with a cylindrical end-piece 76 at its top end, which end-piece is shaped to fit into the top segment 64 of each hole 62. The top segment 64 of each hole 62 thus has a shape complementary to the shape of the end-piece 76, so as to retain the keying finger 72 axially in the hole 62, e.g. by elastic deformation.

For example, the keying finger 72 is force-fitted in the hole 62.

In this embodiment, the keying finger 72 is thus inserted into the hole 62 by being moved in vertical translation downwards until the end-piece 76 fits into the top segment 64 of the hole 62.

In variant embodiments (not shown), the keying finger 72 can be mounted in the hole 62 using other known means, e.g. by screw-fastening or by bayonet-type fastening.

Operation of the assembly of the invention is described below with reference, in particular, to FIGS. 3 to 6.

The ink bottles 40 are delivered in the form shown in FIG. 3, i.e. with packaging caps 50.

For example, the ink bottles 40 are delivered in cardboard boxes (not shown), each cardboard box containing only bottles 40 of ink of a certain color.

The printing machines 10 generally operate with three types of ink which correspond to the three principal colors, namely blue, yellow, and red. It is thus important to fit the bottle 40 containing the correct color on the corresponding base 14 of the printing machine 10, so that each print head 12 is fed with the correct color, i.e. each bottle 40 must be matched with the base corresponding to the color of its ink.

In accordance with the teaching of the invention, each base 14 which is organized to feed a print head 12 with a determined color of ink is provided with an annular groove 38 having a determined diameter Dg.

For example, the blue ink feed base 14 is provided with an annular groove 38 having a first diameter $Dg_1$, the yellow ink feed base 14 is provided with an annular groove 38 having a second diameter $Dg_2$ that is smaller than $Dg_1$, and the red ink feed base 14 is provided with an annular groove 38 having a third diameter $Dg_3$ that is smaller than $Dg_2$.

In order to prepare to mount each ink bottle 40 onto the printing machine 10, it is necessary to unscrew the packaging cap 50 with a view to replacing it with a fitting 42.

Figure 4:
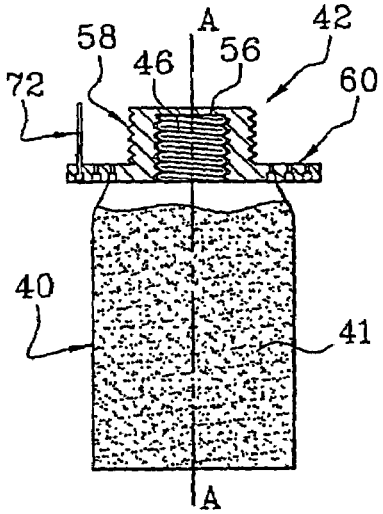
FIG. 4 is an axial section view showing the ink bottle of the assembly of the invention as equipped with a fitting.

As shown in FIG. 4, each bottle 40 containing blue ink is matched with the appropriate base 14 by screwing a fitting 42 provided with a keying finger 72 onto the neck 46 of the bottle 40, the keying finger being inserted into the hole 62 whose radial position corresponds to the diameter $Dg_1$.

Advantageously, the fitting 42 is provided with visual identification means for visually identifying the chosen matching, e.g. in the form of a color code associated with each possible radial position for the keying finger 72.

In one embodiment, the hole 62 that is associated with the base 14 organized for the blue ink is identified with a visual indicator such as a blue circle or line. The other holes 62 are identified in the same way with visual indicators of different colors.

Such visual identification makes it possible to verify at all times that the keying finger 72 that equips a fitting 42 mounted on an ink bottle 40 takes up the appropriate radial position in the fitting 42, as a function of the color of the ink that is contained in the bottle 40 and as a function of the base 14 organized to receive said color of ink.

It should be noted that, when the fitting 42 is screwed onto the bottle 40, said bottle is then closed in leaktight manner by means of the seal 56 carried by the fitting 42, which seal comes into axial abutment against the free axial end edge of the feed opening 48.

Since the bottle 40 is closed, it can be turned upside down so that the neck 46 is at the bottom and the cylinder 44 is at the top, without any risk of ink 41 flowing out of the bottle 40.

Figure 5:
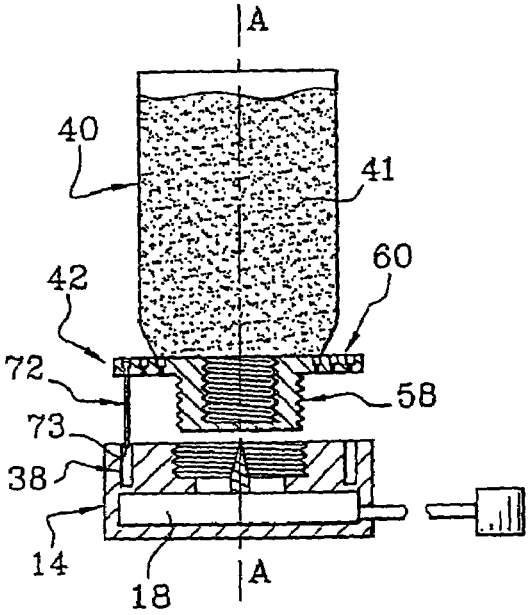
FIG. 5 is a view similar to the FIG. 4 view, showing the ink bottle as equipped with its fitting at the beginning of the stage during which it is mounted in the base of the assembly of the invention.

The bottle 40 as equipped with its fitting 42 then occupies the position that is shown in FIG. 5 and that makes it possible to place the bottle 40 facing the matched feed base 14, i.e. the base whose groove 38 has a diameter $Dg_1$ that corresponds to the radial position of its keying finger 72.

FIG. 5 shows the keying finger 72 as slightly axially engaged in the associated groove 38, and the threaded segment 58 of the fitting 42 is shown in axial alignment with the tapped hole 26 in the base 14 before the threaded segment 58 of the fitting 42 penetrates into the tapped hole 26 in the base 14.

When it takes up its position as fitted into the collar 60, the keying finger 72 projects axially downwards beyond the axial thickness of the threaded segment 58 of the fitting 42, so that the keying finger 72 penetrates into the groove 38 in the base 14 before the first starts of the threaded segment 58 of the fitting 42 co-operate with the tapped hole 26 in the base 14.

Therefore, when the radial position of the keying finger 72 of the fitting 42 does not correspond to the diameter of the groove 38, which normally means that the bottle 40 does not contain the correct color of ink relative to the base 14 on which an attempt is being made to mount it, then the free end 73 of the keying finger 72 comes into axial abutment against the top face 24 of the base 14 before screwing the fitting 42 into the hole 26 in the base can be started, thereby preventing any risk of mounting error.

It should be noted that, in this case, if the keying finger 72 is inserted first into the groove 38, it is still impossible to screw the fitting 42 into the hole 26 in the base 14 because the threaded segment 58 of the fitting 42 cannot be aligned axially with the tapped hole 26.

When the radial position of the keying finger 72 corresponds to the diameter Dg of the groove 38, it is necessary merely to screw the threaded segment 58 of the fitting 42 into the tapped hole 26 in the feed base 14 by causing the bottle 40 as equipped with its fitting 42 to turn about the axis A-A.

During such screwing, the keying finger 72, which is received axially in the groove 38, turns about the axis A-A with the fitting 42 by running along the circumference of the groove 38.

Since the axial length of the keying finger 72 is greater than the axial thickness of the threaded segment 58 of the fitting 42, then the axial depth of the groove 38 is also greater than the axial depth of the tapped hole 26.

During the screwing, the seal 56 comes into axial abutment downwards against the pointed end 32 of the piercing finger 30, thereby causing the seal to be punctuated, thus enabling ink 41 to flow into the chamber 18 in the feed base 14 through the feed opening 48 of the bottle 40 and through the lower hole 28 in the base 14.

It should be noted that the seal 56 operates as a flow-admitting valve. In variant embodiments (not shown), it is possible to replace the seal 56 with some other known type of valve, e.g. a valve of the type described and shown in Document EP-A-0 808 716 or in Document U.S. Pat. No. 6,164,768.

Figure 6:
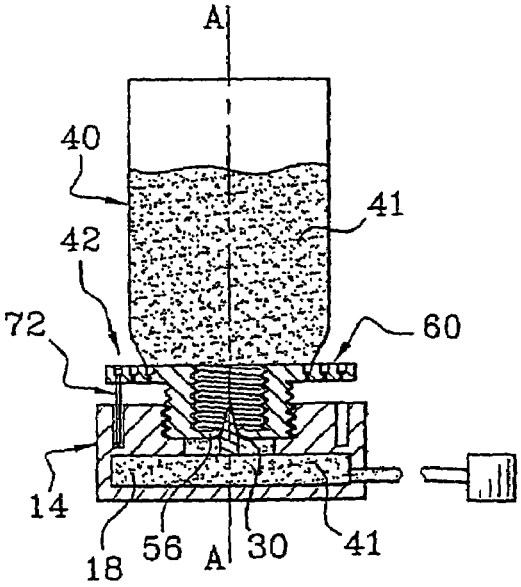
FIG. 6 is a view similar to the FIG. 4 view, showing the ink bottle as equipped with its fitting at the end of the stage during which it is mounted in the base of the invention.

At the end of screwing, the bottle 40 and the fitting 42 thus occupy the position that is shown in FIG. 6 in which the fitting 42 is locked axially in the hole 26 by screw-fastening.

Advantageously, in the embodiment shown in the figures, the same fitting 42 is used for all of the bottles 40, regardless of the colors of the ink that they contain. Differentiating between the fittings 42 to enable them to be matched with determined respective bases 14 is achieved by choosing the radial positions of the keying fingers 72.

In this example, since each fitting 42 is provided with six distinct holes 62 which correspond to six different radial positions for the keying finger 72, then it is possible to implement six different matches for six distinct feed bases 14.

The feed bases 14 which are organized to receive bottles 40 containing ink of different colors are distinguished from one another by the characteristics of the diameters Dg of their annular grooves 38.

Naturally, the fitting 42 and its keying finger 72 can be used to distinguish between other types of substance packaged in bottles 40.

The mode of operation of the assembly of the invention can differ from the mode of operation described above without going beyond the ambit of the invention. In particular, ink bottles 40 can be delivered by the ink manufacturer as already equipped with fittings 42 optionally provided with keying fingers 72.

In a variant embodiment (not shown) of the invention, the fitting 42 can be formed integrally with the bottle 40.

In another variant embodiment (not shown) of the invention, the fitting 42 can be axially locked in the hole 26 in the base 14 by fastening equivalent to screw-fasting, which also requires pivoting about the axis A-A, e.g. by bayonet-type fastening.

It should be noted that, when axially locking the fitting 42 in the hole 26 requires less than one full turn about the axis A-A, then it is possible to provide the annular groove 38 in the base 14 in the form of a segment.

In such an embodiment, it is necessary to choose appropriately the length of the segment and its angular positioning relative to the hole 26, so as to enable the fitting 42 to be pivoted into its locked position. It is important to prevent such pivoting from being impeded by the keying finger 72 coming into circumferential abutment against a circumferential end of the segment of annular axial groove 38.

Naturally, without going beyond the ambit covered by the invention, and by mere mechanical inversion, it is possible to provide an assembly in which the keying finger 72 is carried by the base 14 and in which the annular axial groove segment 38 is carried by the collar 60 of the fitting 42.

FIGS. 7 to 11 show a second embodiment of an assembly of the invention.

The assembly differs from the first embodiment mainly by its fitting 42 and by its base 14 that carry different keying and locking means.

Figure 7:
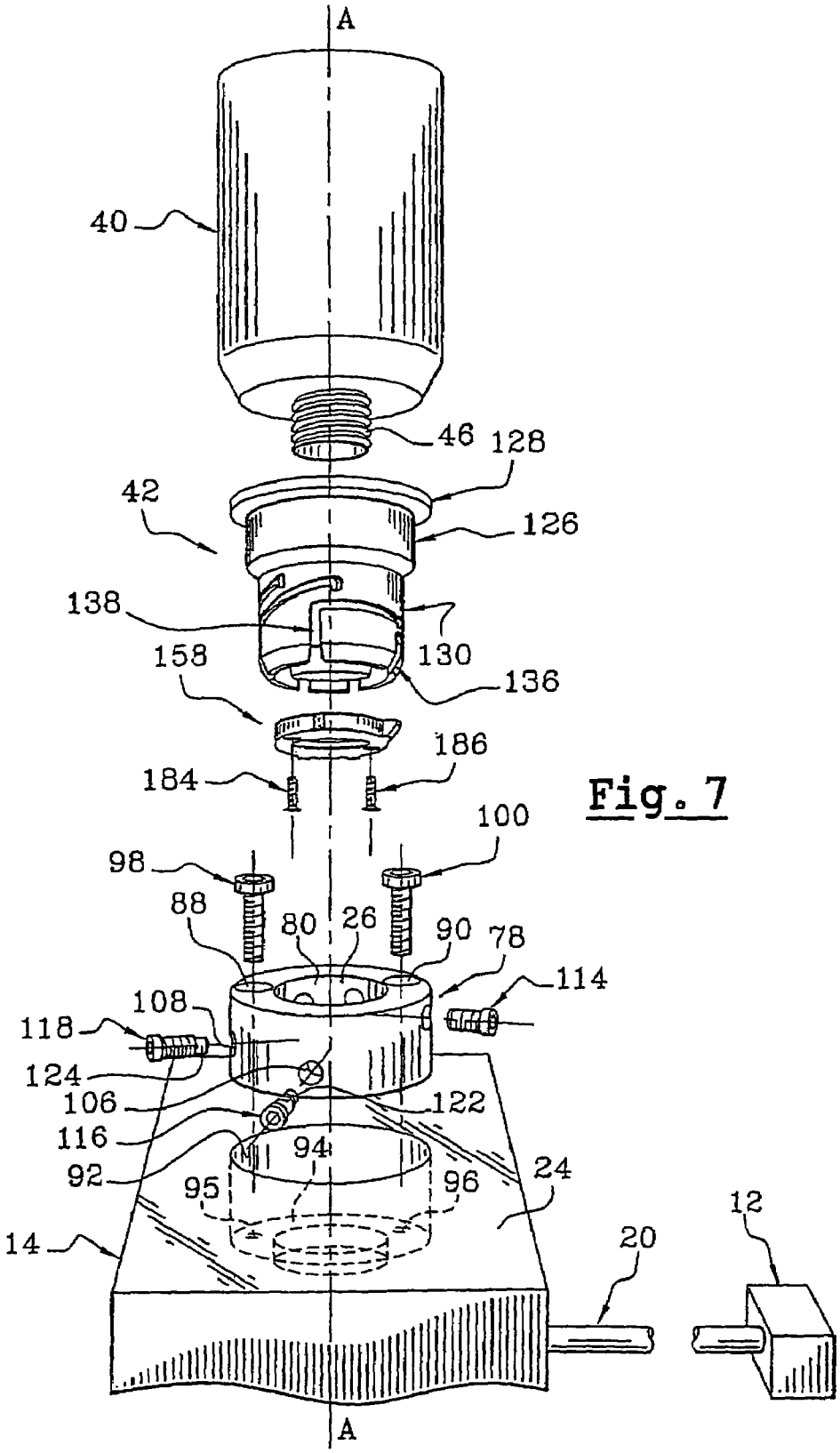
FIG. 7 is a view similar to the FIG. 1 view, showing a second embodiment of the assembly of the invention.

As can be seen in the exploded view of FIG. 7, the base 14 is provided with a separate element in the form of a tubular sleeve 78 which, in this example, is coaxial with the mounting axis A-A.

In a variant embodiment, the sleeve 78 could be formed integrally with the top face 24 of the base 14.

The concave axial wall 80 of the sleeve 78 defines the filling hole 26 of the base 14.

Figure 8:
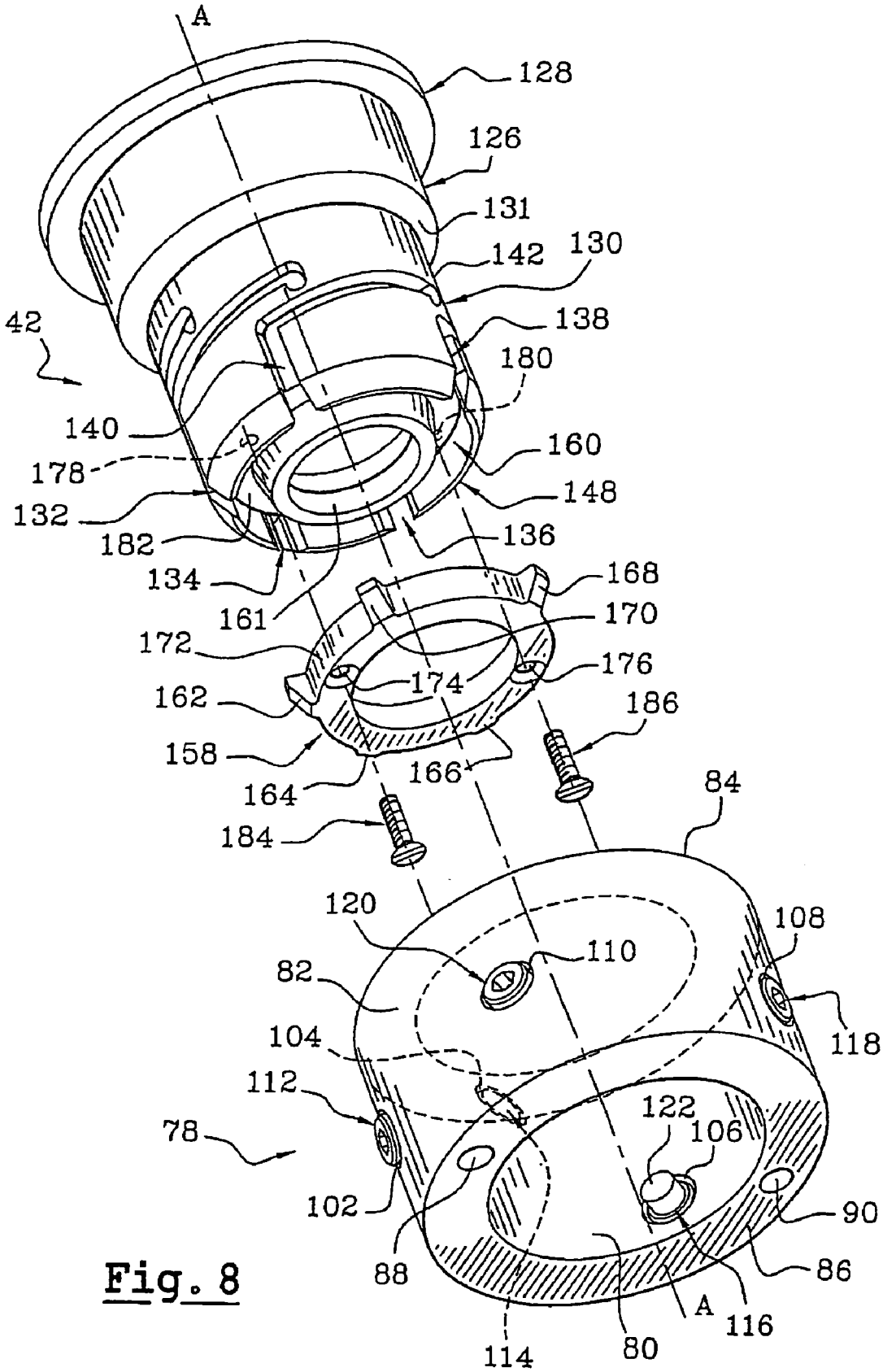
FIG. 8 is an enlarged and exploded perspective view showing the fitting, the ring, and the sleeve of the assembly of FIG. 7.

FIG. 8, in which the sleeve 78 is shown in perspective, shows that the sleeve 78 has a convex axial wall 82 and a top axial end transverse surface 84 and a bottom axial end transverse surface 86.

In this example, the sleeve 78 is provided with two axial holes 88, 90 that are diametrically opposite and that open out in both of the axial end transverse surfaces 84 and 86.

The sleeve 78 is organized to be mounted in a complementary hole or receptacle 92 which is provided in the top face 24 of the base 14, so that the sleeve 78 is contained entirely in the axial thickness of the base 14.

For example, the receptacle 92 has a radial bearing surface 94 organized to receive in axial abutment the bottom transverse surface 86 of the sleeve 78.

When the sleeve 78 is received in the receptacle 92, the axial holes 88, 90 in the sleeve 78 are organized to face associated tapped holes 95, 96 provided in the bearing surface of the receptacle 92 so as to enable the sleeve 78 to be held stationary in the receptacle 92 by means of two screws 98, 100 which are inserted from the top downwards into the axial holes 88, 90.

The sleeve 78 is also provided with a series of tapped radial holes 102, 104, 106, 108, 110, of which there are five in this example, and which pass through the entire radial thickness of the sleeve 78. The radial holes 102, 104, 106, 108, 110 are organized to enable associated screws 112, 114, 116, 118, 120 to be mounted that are screwed in from the outside inwards.

Among said screws 112, 114, 116, 118, 120, certain screws (screws 116 and 118 in this example) carry, at their inner axial ends, respective keying studs or fingers 122, 124 that are substantially cylindrical and that, when the screws 116, 118 are mounted in their tapped holes 106, 108, extend into the sleeve 78 so as to project relative to its concave axial wall 80.

Figure 9:
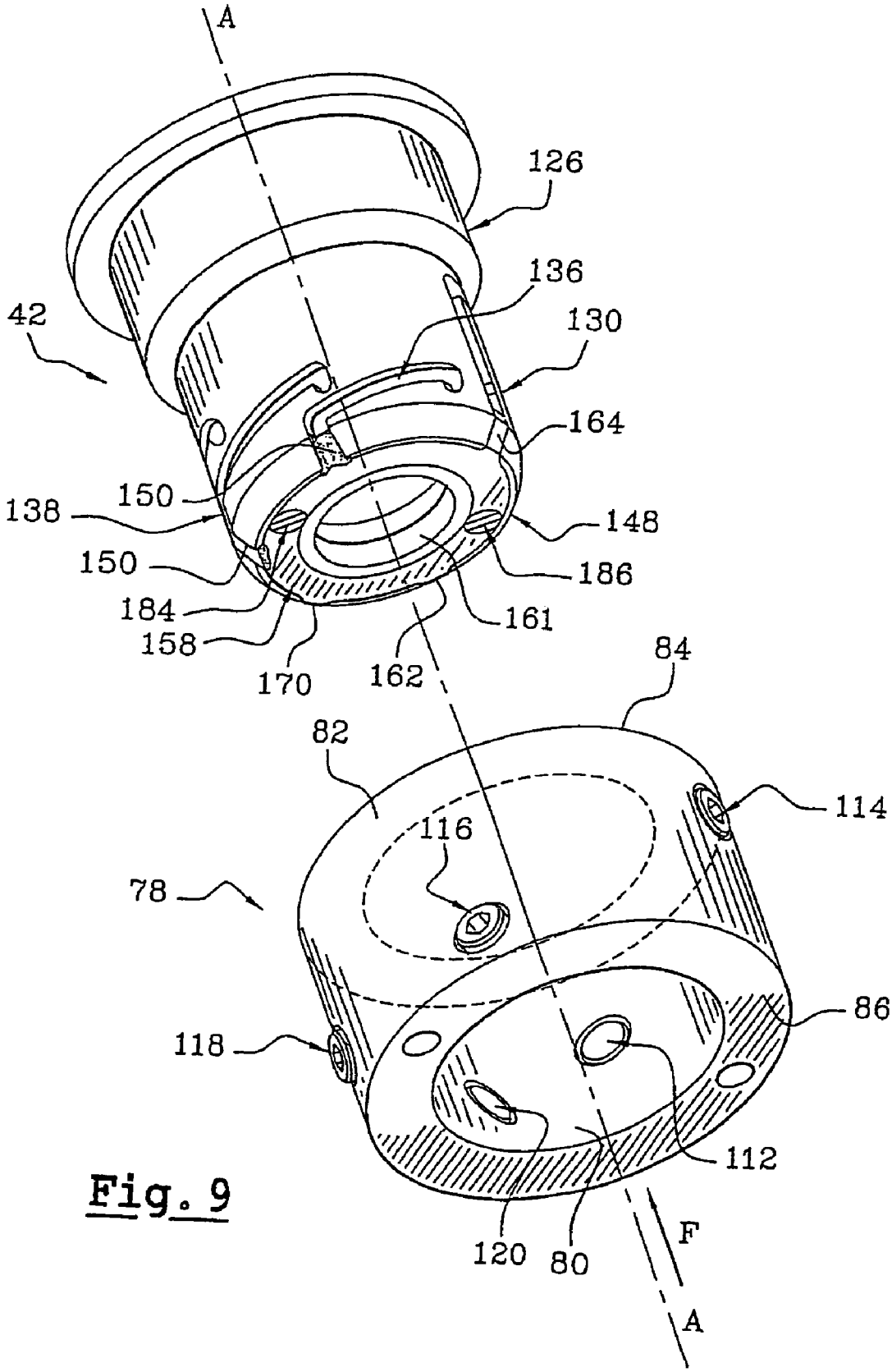
FIG. 9 is a view similar to the FIG. 8 view, showing the ring, with two lugs of the ring having been broken off, in the position in which the ring is mounted on the fitting, and showing the sleeve with its screws carrying the keying studs aligned angularly with the fitting.

FIG. 8 shows the inner axial end of a screw 116 provided with a keying stud 122 which extends into the sleeve 78, and FIG. 9 shows the inner axial ends of two screws 112, 120 that are not provided with studs and that do not project from the concave axial wall 80.

In the enlarged view of FIG. 8, it can be observed that the fitting 42 is substantially cylindrical. It has a top end 126 provided with an outer collar 128 at its top axial end, and a bottom segment 130 whose diameter is smaller than the diameter of the top segment 126, thereby defining a shoulder 131.

Groove or channel segments 132, 134, 136, 138, 140 are formed in the outside axial wall 142 of the bottom segment 130.

Figure 10:
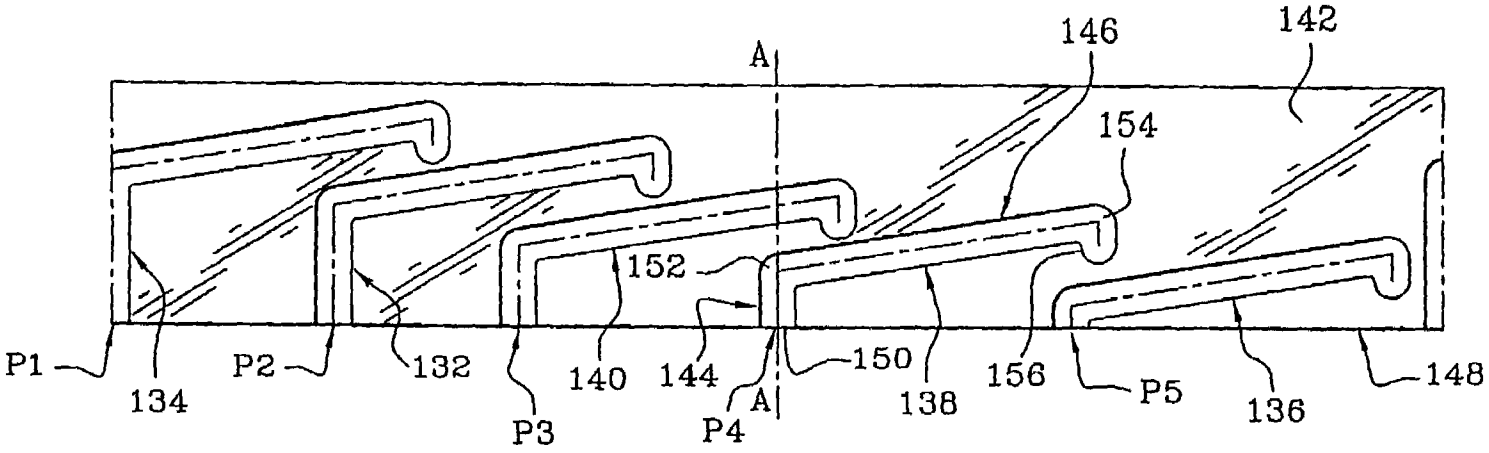
FIG. 10 is a view as laid out or developed, showing the outside axial wall of the bottom segment of the fitting of the assembly of FIG. 7, and showing the shapes and positions of its channels.

FIG. 10 diagrammatically shows the outside axial wall 142 of the bottom segment 130 of the fitting 42 as laid out or developed, thereby showing the shape of the channels 132, 134, 136, 138, 140 and how they are disposed relative to one another.

Each channel 132, 134, 136, 138, 140 has a bottom segment 144 that extends axially, and a top segment 146 that extends substantially circumferentially in the outside axial wall 142.

The bottom segment 144 opens out into the bottom axial end 148 of the fitting 42 via a bottom opening or inlet 150 of the channel.

The top segment 146 of the channel extends circumferentially from the top end 152 of the bottom segment 144. More precisely, it extends in a plane that slopes slightly upwards relative to the radial plane containing the top end 152 of the bottom segment 144.

Advantageously, at its free end 154, each top segment 146 is provided with a locking notch 156 which extends substantially downwards.

As can be seen in FIG. 10, the respective bottom segments 144 of the channels 132, 134, 136, 138, 140 have axial heights that are staggered so that the top segments 146 axially overlap with one another, without intersecting.

In the embodiment shown herein, the channel 136 has the shortest bottom segment 144, then the bottom segments 144 of the other channels respectively 138, 140, 132, 134 are of lengths increasing from right to left as shown in FIG. 10.

It should be noted that, because of the staggering of the axial heights of the bottom segments 144 of the channels 132, 134, 136, 138, 140, the axial positions of the associated radial holes 102, 104, 106, 108 110 in the sleeve 78 must also be staggered in complementary manner. Thus, for example, the radial hole 106 must be as axially low as possible in the sleeve 78 because it is organized to receive the stud 122 that cooperates with the channel 136 that has the bottom segment 144 of shortest length.

The relative angular positions P of the channel inlets 150 correspond to the angular positions of the radial holes 102, 104, 106, 108, 110 in the sleeve 78 for receiving the keying pins 122, 124.

The fitting 42 is also provided with closure means for selectively closing off the channel inlets 150.

As shown in FIGS. 8 and 9, said closure means are, in this example, in the form of a ring 158 which is inserted axially in a complementary annular axial grove 160 provided in the bottom axial end 148 of the fitting 42 around the bottom opening 161 of the fitting 42.

The ring 158 is provided with lugs 162, 164, 166, 168, 170 which extend radially outwards from its outside axial surface 172. The lugs 162, 164, 166, 168, 170 are organized to be engaged axially in complementary manner into respective ones of the channel inlets 150 corresponding respectively to the channels 132, 134, 136, 138, 140.

The lugs 162, 164, 166, 168, 170 are, for example, formed integrally with the ring 158.

In this example, the ring 158 is provided with two diametrically opposite axial holes 174, 176 which are organized to be provided facing tapped axial holes 178, 180 provided in the bottom 182 of the annular groove 160 in the fitting 42 so as to make it possible for the ring 158 to be fixed to the fitting by two associated screws 184, 186.

Before the ring 158 is mounted on the fitting 42, two lugs 166, 168 are broken off, substantially flush with the outside axial surface 172 of the ring 158 so as to open up the inlets 150 of two chosen channels 136, 138 whose angular positions P correspond to the angular positions P of the two keying studs 122, 124 carried by the matched tubular part 78.

In order to facilitate breaking off the lugs 162, 164, 166, 168, 170, each lug can be provided with a score line (not shown).

Instead of breaking off the lugs 162, 164, 166, 168, 170, it is possible to remove them by any other material-removal means, e.g. by filing.

It is also possible to provide removable lugs 162, 164, 166, 168, 170.

In a variant embodiment (not shown), it is also possible to remove the two chosen lugs 166, 168 as of manufacture of the ring 158. Such a solution makes it necessary to provide as many different rings 158 as there are combinations necessary for providing the keying.

FIG. 9 shows the ring 158 in the position in which it is mounted on the fitting 42, and it can be seen that the inlets 150 of the channels 136, 138 are released or "opened" by breaking off the corresponding lugs 166, 168.

In FIG. 9, it is also possible to see the two screws 116, 118 mounted in the radial holes 106, 108 of the sleeve 78 and carrying respective ones of the two keying studs 122, 124 that are not visible in this view.

In the other radial holes 102, 104, 110, the screws 112, 114, 120 do not carry any keying stud, and their angular positions P correspond to the channels 132, 134, 140 whose inlets 150 are closed off by the non-broken lugs 162, 164, 170 on the ring 158.

Figure 11:
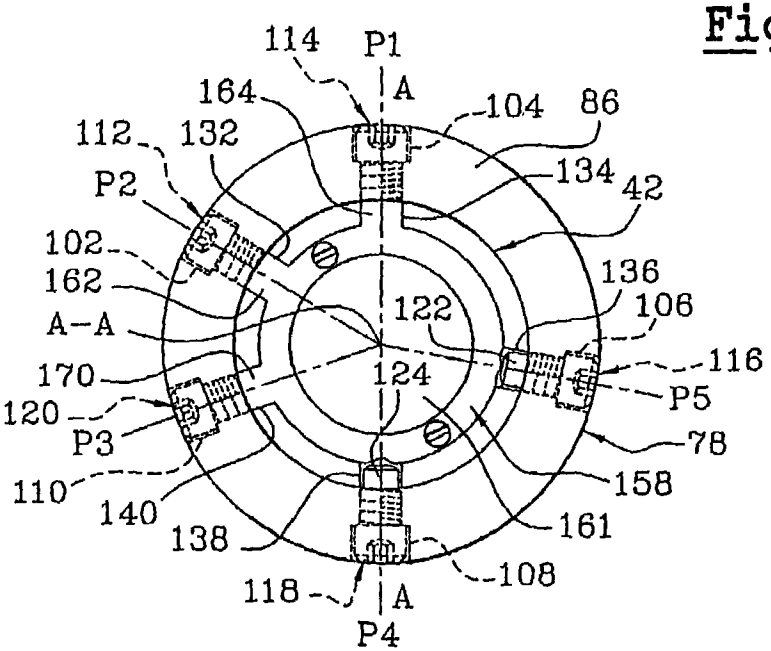
FIG. 11 is an end-on view seen looking along arrow F of FIG. 9, showing the angular alignment of the fitting with the sleeve in the assembly of FIG. 7.

FIG. 11 makes it possible to observe the relative angular positions P of the radial holes 102, 104, 106, 108, 110 in the sleeve 78 and of the channel inlets 150 of the fitting 42 matched to the sleeve 78.

In this embodiment, a first radial hole 104 in the sleeve 78 and the inlet 150 of a first channel 134 are organized in a first angular position referenced "P1".

While arbitrarily taking the first position P1 to be the reference angular position, it has been chosen, in this example, to stagger the angular positions P2, P3, P4, P5 of the other radial holes 102, 106, 108, 110 and inlets 150 of channels 132, 136, 138, 140 in the following manner.

Going around the axis A-A counterclockwise, the second angular position P2 is disposed at 60 degrees, the third angular position P3 at 110 degrees, the fourth angular position P4 at 180 degrees, and the fifth angular position P5 at 260 degrees.

These angle values are given by way of example. They have been chosen so that the angle between any two distinct angular positions P is unique. Thus, two angular positions P cannot define the same angle between them, thereby making it possible to obtain, in this example, ten different combinations of pairs of angular positions P.

As shown in FIG. 11, it has been chosen, in this example, to provide the two keying studs 122, 124 at the fourth and fifth angular positions P4 and P5. Thus, screws 112, 114, 120 without keying studs are provided at the other angular positions P1, P2, P3.

On the ring 158 that is mounted on the fitting 42, the closure lugs 166, 168 corresponding to the two angular positions P4, P5 chosen for the keying studs 122, 124 have been broken off. The channel inlets 150 corresponding to the first, second, and third angular positions P1, P2, and P3 are thus closed off by the lugs 162, 164, 170 remaining on the ring 158.

For example, the fitting 42 is mounted on the container 40 as in the preceding embodiment by screw-fastening. To this end, the top segment 126 of the fitting 42 is provided, for example, with a tapped axial hole (not shown) that is complementary to the thread on the neck 46 of the bottle 40.

Use of the second embodiment of the assembly is explained below.

In accordance with the teaching of the invention, each base 14 that is organized for feeding a print head 12 with a determined color includes a sleeve 78 equipped with two keying studs 122, 124, each of which occupies a determined angular position P, e.g. the fourth position P4 and the fifth position P5 as shown in FIG. 11, for the base 14 associated with blue ink.

In order to match each bottle 40 of blue ink with the appropriate base 14, a fitting 42 equipped with a ring 158 whose lugs 166, 168 corresponding to the fourth and fifth angular positions P4 and P5 are broken off is screwed onto the neck 46 of the bottle 40.

It should be noted that mounting the appropriate ring 158 on the fitting 42 can be performed before or after the fitting 42 is mounted on the bottle 40.

Since all of the fittings 42 are identical, it is the ring 158 and its broken-off lugs 166, 168 that determine the matching between the fitting 42 and the sleeve 78 of the base 14.

Naturally, as indicated with reference to the first embodiment, it is possible to provide visual identification means for visually identifying the chosen matching on the ring 158, e.g. by color marks disposed in the vicinities of the lugs 162, 164, 166, 168, 170.

Once matching has been achieved, it remains to mount the bottle 40 as equipped with the fitting 42 into the matched base 14.

This mounting, of the bayonet-fastening type, includes a first movement in vertical translation, downwards, along the mounting axis A-A, so as to engage the bottom segment 130 of the fitting 42 into the hole 26 in the sleeve 78.

This movement in vertical translation is possible once the two "open" channel inlets 150 have been aligned with the two associated keying studs 122, 124.

During this movement in vertical translation, the fitting 42 is guided by the bottom segment 144 of each "open" channel 136, 138 whose axial walls slide on the associated stud 122, 124.

This movement in vertical translation ends when the fitting 42 is in axial abutment downwards against the suds 122, 124, which studs find themselves at the top axial end 152 of the bottom segment 144 of each "open" channel 136, 138.

A pivoting movement about the mounting axis A-A clockwise as looking downwards is then applied to the fitting 42, the keying studs 122, 124 then co-operating with the top segments 146 of the "open" channels 136, 138.

Since the top segments 146 are inclined upwards, the pivoting then simultaneously causes the fitting 42 to be moved axially downwards until each of the keying studs 122, 124 comes up against the end 154 of the channel 136, 138 at the associated notch 156.

It should be noted that, if an attempt is made to mount the fitting 42 into a sleeve 78 that does not match it, then it is not possible to align angularly the two "open" channel inlets 150 with the two keying studs 122, 124 carried by the sleeve 78 since said studs do not occupy the appropriate angular positions P4, P5. The bottom axial end 148 of the fitting 42 then comes into abutment axially against the facing top surfaces of the keying studs carried by the sleeve 78, thereby preventing the fitting 42 from being mounted in the sleeve 78.

Advantageously, while the fitting 42 is being moved axially downwards, said fitting compresses a compression resilient element such as a coil spring (not shown) so that said resilient element urges the fitting 42 axially upwards. Therefore, when the keying studs 122, 124 come into register with the locking notches 156 and when the user ceases to press axially downwards on the bottle 40 and the fitting 42, then the drive from the spring causes the fitting 42 to return slightly upwards so that the keying studs 122, 124 engage in the locking notches 156 of channels 136, 138, thereby locking the fitting 42 in the base 14.

It can thus be observed that, in this example, the studs 122, 124 act both as keying means when they engage in the inside segment 144 of each channel 136, 138, and also as locking means when they engage in the locking notches 156 in each top segment 146.

In the figures associated with the second embodiment of the invention, no flow-admitting valve is shown.

This embodiment can use a flow-admitting valve similar to the valve described with reference to the first embodiment, with a piercing spike and seal system.

However, it is advantageously possible to provide a valve member provided with a spring and disposed in the lower opening of the fitting 42, and which is caused to open by a control surface carried by the base 14.

Such an assembly is well known. For example, reference can be made to Document U.S. Pat. No. 6,164,768 which describes a valve member controlling admission of flow of the ink contained in the bottle.

Advantageously, it is the spring of the valve member that causes the fitting 42 to be locked in the base 14 by the studs 122, 124 engaging in the locking notches 156, as described above.

By mere mechanical inversion, the channels 132, 134, 136, 138, 140, for example, can be formed in the concave axial wall 80 of the sleeve 78 and the keying studs 122, 124 can be mounted in the outside axial wall 142 of the bottom segment 160 of the fitting 42.

However, for reasons of ease of manufacturing, it is preferred to provide the channels 132, 134, 136, 138, 140 in the fitting 42, e.g. by machining.

In the second embodiment described herein, the studs 122, 124 and the channels 132, 134, 136, 138, 140 serve both for keying and for locking the fitting 42 in the base 14. In a variant embodiment (not shown) of the invention, the studs 122, 124 and the channels 132, 134, 136, 138, 140 can serve for keying only. In which case, each channel 132, 134, 136, 138, and 140 has only an axial segment 144 and locking is obtained, for example, as in the first embodiment, by screw-fastening, the concave axial wall 80 of the sleeve 78 being tapped, and the bottom segment 130 of the fitting 42 being threaded.

The invention claimed is:

1. An assembly for feeding fluid to equipment comprising a feed base provided with a filling orifice communicating with at least one feed duct for feeding fluid to the equipment, wherein the fluid is packaged in a container provided with a feed opening which is adapted to be connected to the filling orifice of the feed base via a fitting that is pre-mounted on the container, and including first axial locking means for mounting the fitting on the container and second axial locking means for mounting the fitting on the base, wherein mounting the fitting on the base comprises moving the fitting in translation along a vertical mounting axis, and pivoting the fitting about the mounting axis;

wherein the fitting is provided with at least one keying finger which extends substantially vertically and which, while the fitting is being pivoted, is received axially in a matched annular axial groove segment which is formed in an axial end face of the base facing the keying finger, so that a container equipped with the fitting can be mounted only on a determined base provided with the groove matched with the keying finger on the fitting.

2. An assembly according to claim 1, wherein the radial position of the keying finger relative to the mounting axis of the fitting determines the matching.

3. An assembly according to claim 2, further comprising means for adjusting the radial position of the keying finger.

4. An assembly according to claim 3, wherein each keying finger is a removable piece that is mounted in a complementary hole carried by the fitting.

5. An assembly according to claim 4 wherein each fifing is provided with a plurality of holes, each of which is disposed in a distinct radial position relative to the mounting axis.

6. An assembly according to claim 4 wherein an axial end of the fitting has a collar that extends substantially radially outwards and that is provided with at least one hole for receiving a keying finger.

7. An assembly according to claim 1, wherein the filling orifice in the base is tapped and the fitting has a complementary threaded cylindrical portion for mounting the fitting on the base.

8. An assembly according to claim 1, wherein the feed opening of the container is provided at the free axial end of a neck provided with a thread and the fitting has a complementary tapped hole for mounting the fitting on the container.

9. An assembly according to claim 1, wherein the fitting is provided with visual identification means for visually identifying the matching.

10. An assembly according to claim 9, wherein said visual identification means comprises a color code associated with each position of the keying finger or the keying studs.

11. An assembly according to claim 1, wherein the container or the fitting is provided with a flow-admitting valve which is triggered by mounting the fitting on the base.

12. A printing machine including an assembly according to claim 1.

13. An assembly for feeding fluid to equipment comprising:

a feed base having a filling orifice communicating with at least one feed duct for feeding fluid to the equipment;

a fitting having a first axial locking means for coupling the fitting to a container that supplies said fluid, and second axial locking means for mounting the fitting on the base via translation along a vertical mounting axis and pivoting the filling about the mounting axis;

at least one keying finger on the fitting which extends substantially parallel to said axis; and an annular axial groove segment which is formed in an axial end face of the base facing the keying finger such that, while the fitting is being pivoted, said keying finger is received axially in said groove, so that a container coupled to the fitting can be mounted only on a determined base provided with the groove matched with the keying finger on the fitting.

14. An assembly according to claim 13, further comprising means for enabling the radial position of the keying finger on the fitting to be adjusted, to enable the fitting to be matched to different bases.

15. An assembly according to claim 14, wherein said fitting has a plurality of radially displaced holes, and said keying finger is a removable piece that is mounted in one of said holes.

16. An assembly for feeding fluid to equipment comprising a feed base provided with a filling orifice communicating with at least one feed duct for feeding fluid to the equipment, wherein the fluid is packaged in a container provided with a feed opening which is adapted to be connected to the filling orifice of the feed base via a fitting that is pre-mounted on the container, and including first axial locking means for mounting the fitting on the container and second axial locking means for mounting the fitting on the base, wherein mounting the fitting on the base comprises moving the fitting in translation along a vertical mounting axis, and pivoting the fitting about the mounting axis;

wherein at least one keying stud projects radially from a concave axial wall of the base and, while the fitting is moving in translation, is received in a matched channel that is provided in an outside axial wall of the fitting, so that the container can be mounted only on a determined base as a function of the matching of the fitting with the base, said matching being defined by the keying stud co-operating with the matched channel.

17. An assembly according to claim 16, wherein each base is provided with at least two keying studs, and wherein the angular position of the keying studs and of the associated channels relative to the mounting axis determines the matching of the base with the fitting.

18. An assembly according to claim 17, wherein each channel opens out in an axial end of the fitting via an opening or inlet.

19. An assembly according to claim 18, wherein the fitting is provided with all of the channels complementary to all of the possible positions for the keying studs, and wherein the fitting is provided with closure means for closing off the inlets of the channels which do not correspond to the actual positions chosen for the keying studs carried by a base that is matched to the fitting, so as to prevent the fitting from being mounted in a base whose keying studs do not occupy the angular positions corresponding to the "open" channels.

20. An assembly according to claim 19, wherein the fitting is provided with a ring which is mounted at its axial end and which is provided with lugs extending radially outwards from its outside axial surface, so as to close off the inlets of the channels which do not correspond to the actual positions chosen for the keying studs.

21. An assembly according to claim 16, wherein each matched channel includes a first segment which extends substantially axially from the inlet of the matched channel and a second segment which extends substantially circumferentially from the end of the first segment, the second segment having locking means for locking the stud so as to enable the fitting to be locked in the base using bayonet-type fastening.

22. An assembly according to claim 16, wherein each keying stud is carried by an inner axial end of a screw which is mounted in a radial hole opening out in the concave axial wall of the base.

23. An assembly according to claim 16, wherein the base includes a separate sleeve which internally defines the filling orifice, which carries the keying stud, and which is mounted in a hole of complementary shape formed in an axial end face of the base.

24. An assembly for feeding fluid to equipment comprising:

a feed base having a filling orifice communicating with at least one feed duct for feeding fluid to the equipment;

a fitting having a first axial locking means for coupling the fitting to a container that supplies said fluid, and second axial locking means for mounting the fitting on the base via translation along a vertical mounting axis and pivoting the fitting about the mounting axis;

at least one keying stud which projects radially from a concave axial wall of the base; and a channel formed on an outside axial wall of the fitting such that, while the fitting is moving in translation along said axis, said keying stud is received in said channel so that a container coupled to said fitting can be mounted only on a determined base as a function of the matching of the fitting with the base.

25. An assembly according to claim 24, wherein said base has at least two keying studs, and said fitting has associated channels that each opens to an axial end of the fitting via a respective inlet.

26. An assembly according to claim 25, wherein the fitting is provided with channels complementary to all of the possible positions for the keying studs, and wherein the fitting further includes closure elements for closing off the inlets of the channels which do not correspond to actual positions of the keying studs on a base that is matched to the fitting, to thereby prevent the fitting from being mounted in a base whose keying studs do not occupy the angular positions corresponding to the open channels.

27. An assembly according to claim 26, wherein said closure elements comprise lugs extending radially outwards from an axial surface of a ring, so as to close off the inlets of the channels which do not correspond to the actual positions of the keying studs.

28. An assembly according to claim 24, wherein the base includes a sleeve which internally defines the filling orifice, which carries the keying studs, and which is mounted in a hole of complementary shape formed in a top face of the base.

* * * * *